United States Patent [19]

Maria

[11] 4,366,935

[45] Jan. 4, 1983

[54] DEVICE AND PROCESS FOR SPINNING OR TWISTING AND WINDING YARN

[76] Inventor: Jacobo G. Maria, 93 Ave. Norte #630, San Salvador, El Salvador

[21] Appl. No.: 218,252

[22] Filed: Dec. 19, 1980

Related U.S. Application Data

[63] Continuation-in-part of Ser. No. 162,049, Jun. 17, 1980, abandoned.

[51] Int. Cl.[3] ..... D01H 1/04; D01H 1/02; D01H 7/44; D01H 7/90

[52] U.S. Cl. ..... 242/159; 57/67; 57/71; 57/75; 57/115; 57/117

[58] Field of Search ..... 57/67–71, 57/75, 126, 115, 117; 242/159

[56] References Cited

U.S. PATENT DOCUMENTS

| | | | |
|---|---|---|---|
| 432,856 | 7/1890 | Boelsterli | 57/67 |
| 1,048,920 | 12/1912 | Watzlawik | 57/117 |
| 2,449,431 | 9/1948 | Weiss | 57/70 X |
| 2,526,247 | 10/1950 | Lewis | 57/70 |
| 2,836,955 | 6/1958 | Frenzel | 57/70 X |
| 3,174,270 | 3/1965 | Blaschke | 57/67 |
| 3,357,170 | 12/1967 | Pfeifer | 57/67 X |
| 3,724,195 | 4/1973 | Moore | 57/75 |
| 4,060,969 | 12/1977 | Costales et al. | 57/67 X |
| 4,196,572 | 4/1980 | Hunt | 57/70 X |
| 4,246,746 | 1/1981 | Rumsey et al. | 57/75 |

FOREIGN PATENT DOCUMENTS

| | | | |
|---|---|---|---|
| 720231 | 12/1954 | United Kingdom | 57/126 |

*Primary Examiner*—John Petrakes
*Attorney, Agent, or Firm*—John Cyril Malloy

[57] ABSTRACT

A process and an improved device for spinning or twisting and winding yarn is disclosed which is for use with a yarn spinning or twister device which conventionally includes a traveler assembly of a type used in textile mills. The device includes a driven rotor disposed axially through the twister device such as the twister ring and traveler assembly with a twisted yarn extending downwardly from the traveler, through a first radially facing hole in the rotor, and a second axially facing hole through an up-down reciprocating carrier bar supporting a depending rotatable free spinning yarn guide frame, designed to guide the yarn outwardly and downwardly and into a convolutely wound engagement along the length of a bobbin engaged on a driven spindle driven, and including a brake to arrest rotational movement of the yarn guide frame when the winding operation is discontinued. Preferably, the rotor or artificial bobbin is driven at the same revolutions per minute as the spindle.

30 Claims, 4 Drawing Figures

DEVICE AND PROCESS FOR SPINNING OR TWISTING AND WINDING YARN

This is a continuation-in-part of my copending patent application entitled "Yarn Twist-Wind Device," Ser. No. 162,049, filed June 17, 1980. now abandoned.

STATE OF THE PRIOR ART

Textile mills currently form yarn from sliver or roving made of multiple fibers which are first passed through a series of pairs of drafting or stretching rollers. From the drafting rollers, the yarn is extended through a guide and then to the traveler on a twister ring, where the plurality of fibers are twisted together to form a yarn, the twister ring and traveler being mounted on an up-down reciprocating bar. The purpose of the reciprocating bar is to distribute the twisted yarn on a small bobbin. The bobbins of the prior art have been small because of limitations, including the diameter of the ring and the tangential speed of the traveler of the ring, limitations which are overcome by this invention. A rotatably driven spindle is axially disposed relative to the twister ring and traveler whereby the twisted yarn is directly wound about the length of a small bobbin disposed on the spindle, as the above process continues.

Also, in the past, to form plied yarn or twisted yarn, two or more threads were first passed through a pair of rollers. From these rollers, the threads extended through a guide and then to a traveler on a twister ring, where the plurality of yarns are twisted together to form a strand of yarn. The twister ring and traveler are mounted on an up-down reciprocating bar, once again, for the purpose of distributing the twisted yarn on a small bobbin.

Obviously, using the prior art techniques, the completed package, as the yarn filled bobbins are referred to in the art, are limited in size by the inside diameter of the twister ring. Therefore, to form large packages, it has been conventional that a plurality of the smaller packages are successively rewound with their ends being tied together by knots to form a large package which may be in several different configurations, this process taking place in a separate winding operation on separate winding machines in a separate room or area which is usually one of the largest areas in conventional textile mills. This separate winding operation is very expensive from the point of view of labor, cost, space, energy and the high cost of the winding machines. The resulting product, often a cone, is composed of lengths of yarn tied end-to-end by knots so that there are several knots, up to 7, 8, or more which, as is well known in the art are undesirable.

BACKGROUND OF THE PRESENT INVENTION

The present invention provides for relatively big yarn packages of a more precise winding than those of the prior art and packages which are free of knots. The present invention also provides a device for spinning or twisting yarn and, on the same machine, for winding the yarn on a relatively big package, instead of tying the ends of smaller packages together in a rewinding operation to make a relatively large package. The device includes a guide for the yarn and a fixed twister ring and traveler assembly mounted on a stationary support bar, as opposed to the prior art structure wherein the ring and traveler reciprocated in an axial movement. The device further includes an axially extending driven rotor extending therethrough. The material to be twisted, from a drafting system or rollers, is guided downwardly by the structure of this invention from a guide to the traveler on the ring, through the driven rotor to an inverted U-shaped yarn guide frame. The yarn guide frame is rotatably journaled for free spinning to the underside of an up-down reciprocating carrier bar member. From the vertical rotor, the yarn is guided by the yarn guide frame, first, outwardly and downwardly through one leg of the U-shaped frame and, second, inwardly onto the package being convolutely wound along the length of the package, whether cone-shaped or otherwise. The package is carried on a rotatably driven spindle, positioned axially between the legs of the U-shaped yarn guide frame, and, as the substantially free spinning yarn guide frame, which is pulled by the yarn, is reciprocated upwardly and downwardly, as opposed to the prior art wherein the twister ring and traveler reciprocated upwardly and downwardly, the spindle rotates preferably at the same speed as the rotor while the yarn guide frame, which is substantially free spinning, is pulled by the yarn.

OBJECTS OF THIS INVENTION

Therefore, one of the principal objects of the invention is to provide a package of twisted yarn which is free and clear of knots and rather precisely wound and also it is an object to provide a device which is adapted to produce substantially larger twisted packages than has been heretofore possible.

A further object of the present invention is to provide a device which directly produces substantially enlarged yarn packages in a variety of configurations, for example, in cylindrical and truncated conical shapes, hereinafter referred to generally as bobbins whether cone-shaped or cylindrically shaped for yarn packages.

Another object of the invention is to provide a device which can be used alone or in combination with a plurality of the devices and which substantially reduces yarn breakage as the yarn threads pass from the drafting system or rollers to the guide and the traveler of the twister ring. This is because, in this invention, the rail or support for the twister ring is fixed and, consequently, the distance between the thread guide from the drafting sytem or rollers to the traveler of the twister ring remains constant, as opposed to the prior art where this distance is always changing. This avoids substantial changes of tension on the material being twisted between the guide and the traveler. As a result, a better and more even quality of yarn is a result of this invention and an object of it.

Yet another object of the present invention is to provide a machine capable of higher speeds and which prolongs the life of the traveler. The higher speeds are possible because the disclosed structure permits a smaller diameter ring, and hence a smaller circumference, so that the tangential speed of the traveler, which speed is the function of the diameter of the ring, may be substantially reduced. Thus, the angular velocity of r.p.m.'s of the spindle and rotor may be increased without fear of heating the traveler from heat friction caused by relative movement of the traveler about the ring. Heat build up has been a limitation on speed of production because larger diameter rings were required by the structures of the prior art. Also, since the disclosed structure permits the use of a smaller twister ring, and a consequence substantially reduced traveler speed of the traveler, yarn beakage is reduced.

A still further principal object of the invention is the elimination of the rewinding operations of a plurality of small packages to form a larger package of relatively short lengths of twisted yarn tied together by objectionable knots. This results in a very substantial savings in money, time and factory space and a product of increased quality.

Another object of the invention is to substantially reduce the number of bobbin doffings, saving interruptions caused by the necessity of stopping machines for the doffing operations eliminated in large part by this invention, and in general to save time and labor costs.

A particular advantage of the present invention is that the number of spindles per worker is increased because of the reduction of breaks, and there are less doffings due to the larger packages, approximately three pounds or more, instead of the one-half to three-quarters pound per bobbin on conventional devices of this type.

A significant object of this invention is a machine capable of making relatively large packages of a substantial axial height in relation to those of the prior art. This is possible because, in contrast to the prior art machines, when the tension of the yarn is varied substantially between the guide and the traveler on the ring due to up-down reciprocating movement of the ring and traveler assembly, this invention maintains the same tension and a fixed distance between the guide and the traveler because the traveler assembly remains in a fixed location and it is the substantially free spinning yarn guide frame which distributes the twisted yarn axially along a package. In other words, the twist ring assembly does not telescope up and down the package as it is being made cyclically increasing and slackening the tension between the guide and the traveler.

In accordance with these and other objects which will become apparent hereinafter, the instant invention will now be described with reference to the accompanying drawings in which

DESCRIPTION OF A PREFERRED EMBODIMENT

Figure 1:
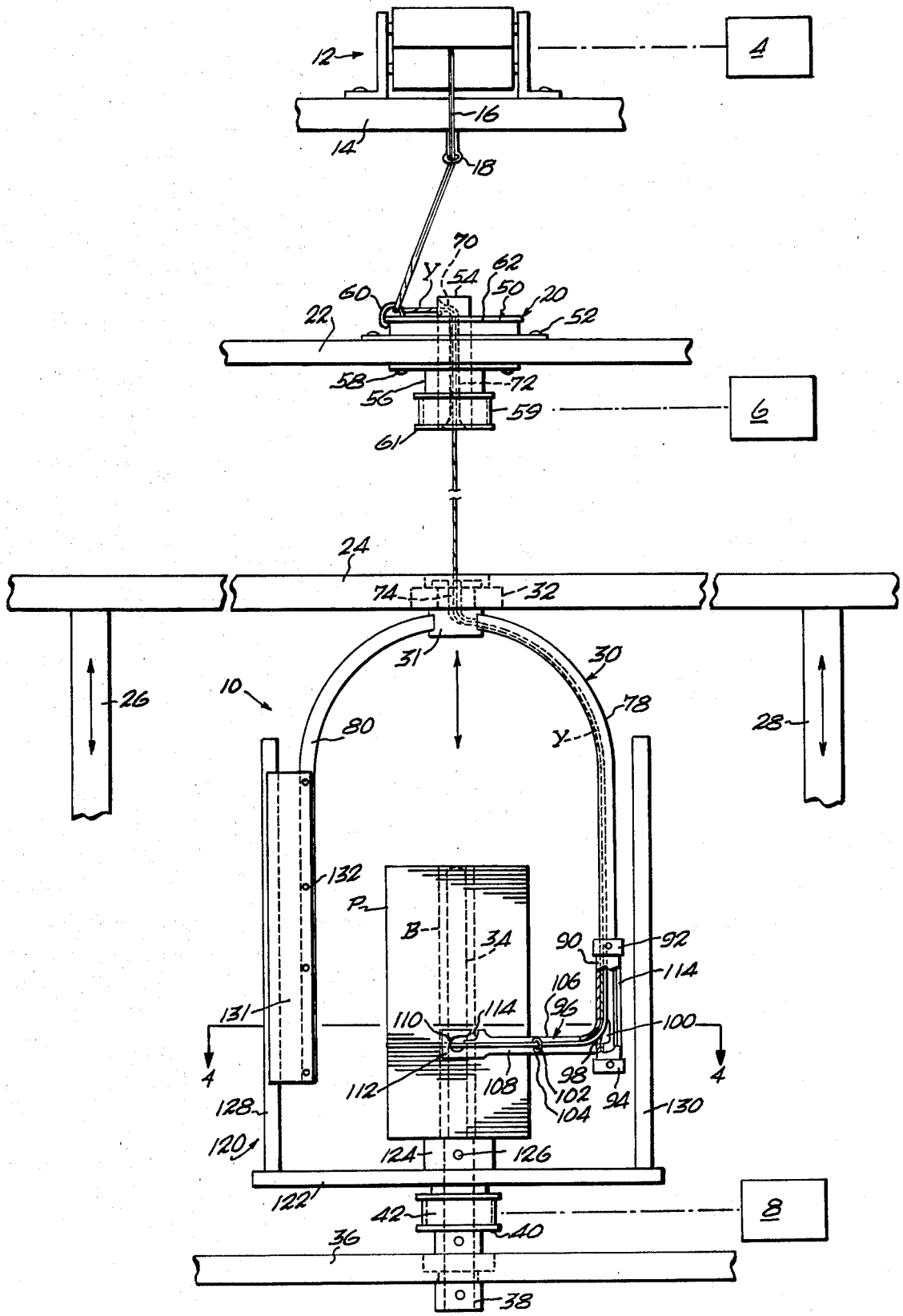
FIG. 1 is a front elevational view of the yarn twist-wind device of the present invention.
Figure 2:
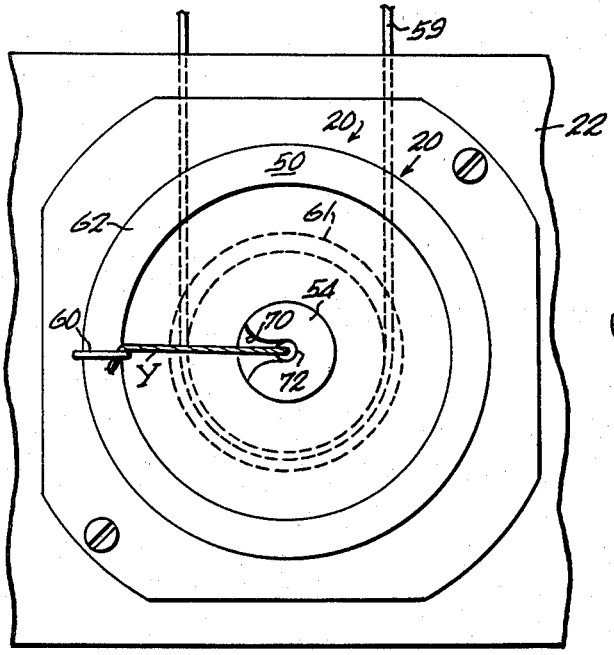
FIG. 2 is a top plan view of a yarn twister ring and traveler with an axially extending driven rotor shaft with hole means therethrough for through passage of a yarn strand.
Figure 3:
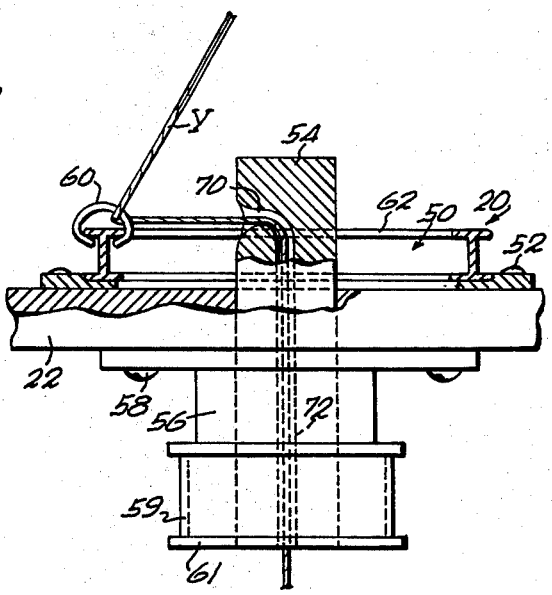
FIG. 3 is a side view of FIG. 2, partially in cross section.

With reference to the drawings, and particularly to FIG. 1, the twisting and winding device of the present invention, indicated generally at 10, is illustrated with a plurality of fragmentary elements. In a conventional setting, it is intended, as is conventional, that the machine will be associated with similar machines of a bank of like units or machines.

First, a top roller assembly, generally indicated at 12, is mounted on a first support 14 and comprises a stretching or drafting system which conventionally discharges a plurality of fibers or rollers discharging strings or threads 16, through a guide means 18 to a generally conventional traveler on a twisting ring assembly 20. The drafting system or rollers 12 are driven in a conventional manner. It will be noted that in this invention the twisting ring assembly which includes a rotor is mounted on a second support 22 which is fixed in relation to the first support 14. This is in contrast with the prior art wherein the twisting ring assembly is reciprocable up and down. Next, the twisted yarn strand is directed to an up-down reciprocating carrier bar 24. This up-down reciprocating carrier bar may be for a single machine, as shown in the drawings, or be common to an entire bank of such machines. In the past, a twister ring, such as 20, was carried on an up-down reciprocating bar instead of a fixed bar as shown. The up-down reciprocable movement of the carrier bar 24 is imparted by opposed end drive means such as cams, not shown, but illustrated schematically by the arrowed lines as at 26 and 28.

An inverted generally U-shaped frame 30, of the present invention, is rotatably supported for substantially free or spinning rotation by means of a central top hub 31, in a depending relation to the bottom side of the up-down carrier bar 24, through a bearing 32 fixed therein.

A spindle 34 is rotatably supported through a fixed bottom support member 36, engaged between a fixed collar 38 and a fixed pulley 40 engaged by a first drive belt 42. Pulley 40 and first drive belt 42 are driven from a common drive shaft (not shown) to each spindle in the bank of yarn machines in a conventional manner.

Referring now to the twisting ring assembly 20 on the fixed second support 22, this assembly includes a conventional twisting ring 50, fixed at 52 to the fixed second support 22. It also includes a vertical rotor 54 or artificial bobbin which is rotatably axially supported through a bracket 56, fixed at 58 to the underside of support 22. The rotor is rotatably driven by a second drive belt 59 and pulley 61 preferably at the same speed and in the same manner as the first pulley 40 and drive belt 42 of the spindle. This is so that the twist is not lost, except to the extent that it may be desired to affect the twist of the yarn on the finished wound package. Finally, it includes a conventional traveler 60 engaged with the annular track 62 of the twisting ring 50 for free circular movement, as is conventional. Through the traveler on the ring, the strings, yarn or fibers to be twisted, which are designated by the numeral 16, are passed through from the drafting sytsem or rollers 12. When the device is operated, as will be subsequently described, the rotor 54 causes the traveler to spin around the ring 50 as the yarn is pulled through the traveler into the rotor or artificial bobbin while it is rotating, imparting a twist to the plurality of strings, etc., to form the yarn Y.

However, in conventional prior art devices of this nature, only a relatively small package was twisted. The prior art spindle carried a bobbin, as opposed to an artificial bobbin, i.e., the rotor, and was rotated while the twisting ring was axially reciprocated in telescoping relation up and down about the bobbin. This distributed the yarn directly onto the bobbin as the ring moved in telescoping relation up and down along the bobbin. This limited the size of the package to the diameter of the hole in the telescoping ring. Thus, the prior art was confronted with a trade-off which was required between the size of the package which could be made, preferably the larger the better, and the diameter of the hole of the traveler ring, preferably the smaller the better, so as to avoid the heat build-up caused by friction of the traveler on the higher circumferential length of the ring, as it went around and around on the ring. The larger the diameter, the longer the ring circumference, and the more relative travel of the traveler per revolution with the attendant more heat of friction per revolution. Thus, only relatively small bobbins because of the limitation of the ring size were wound in a conventional installation of the prior art. This trade-off brought limitations in the size of the packages which could be made and necessitated a winding operation to remove the twisted yarn from the relatively small bobbins and transfer it to a relatively big package.

Figure 4:
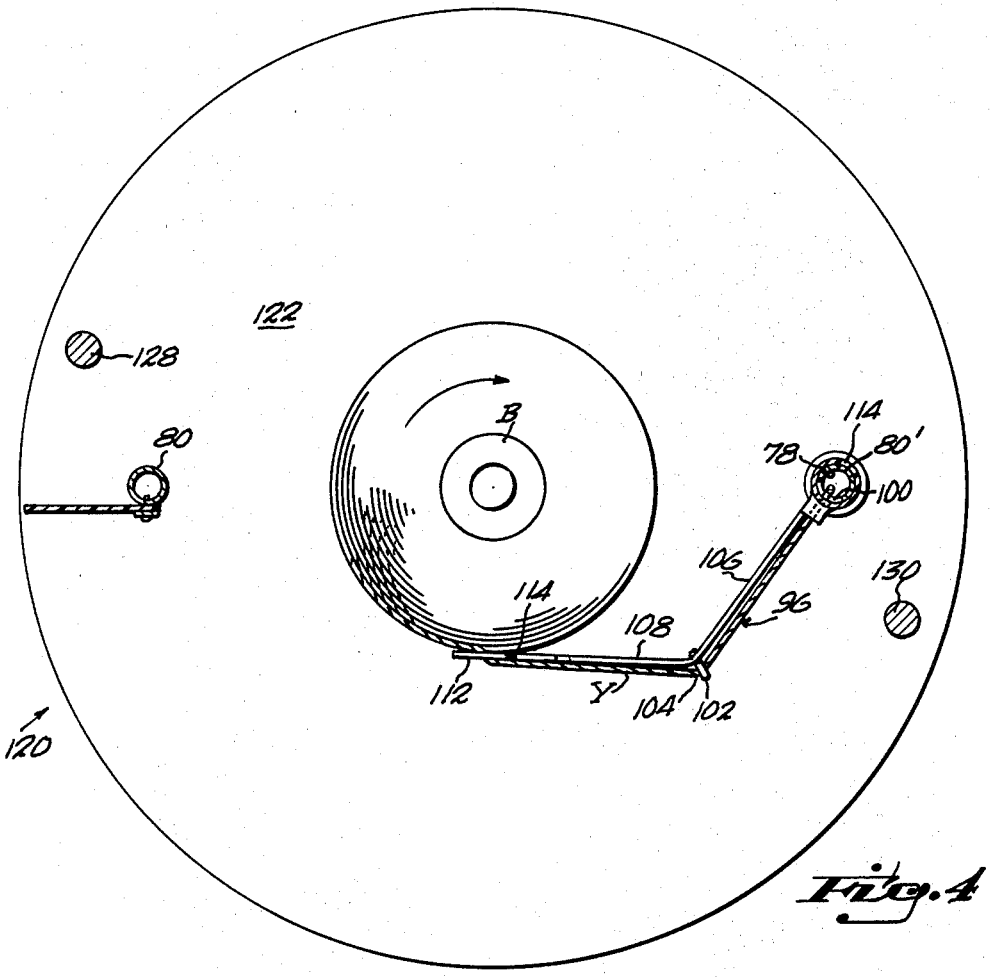
FIG. 4 is a cross sectional view taken along line 4—4 of FIG. 1, in the direction of the arrows.

In the present invention, the rotor 54 is an artificial bobbin and includes a radial hole portion 70 to receive and guide the yarn Y to the vertical axis. The side wall of the hole 70 and its mouth pulls the yarn while in turn this causes the traveler to move about the ring which imparts the twist. The radial hole portion 70 connects with the downwardly extending axial rotor hole portion 72 from which the yarn emerges at the bottom for passage through an angular hole 74 in the top end axially disposed rotatable hub 31 of the free spinning yarn guide frame 30, which in the disclosed embodiment and best mode is composed of a pair of spaced apart downwardly extending parallel legs 78 and 80. At least one leg, such as 78, is generally tubular in form for through passage of the yarn strand Y in a generally outwardly and downwardly direction. In a preferred form, an outer side of leg 78 is vertically slotted as at 80', FIG. 4, for easy initial manual insertion of the yarn strand. The substantially free spinning yarn guide frame which directs the yarn generally outwardly and downwardly may be of any suitable shape, such as bell-shaped, or other type cross section, such as an outwardly opening channel, to define the guide passageway for the yarn Y. Free spinning as used in this disclosure means that the yarn guide frame is caused to turn by the pull of the yarn being wound on the package. It will be recognized that some drag might be applied, however, that should be considered to be substantially free spinning and within the scope of this disclosure.

In the preferred embodiment, a support sleeve 90 is pivotably disposed for movement of adjustment about a vertical axis through the lower end portion of leg 78. This may be done in any desired manner such as by upper and lower collars 92, 94, which are fixed to leg 78. From this sleeve at a rigid elbow there extends a yarn guide arm 96 which pivots with the sleeve and extends generally inwardly from a bottom end of the sleeve 90, FIGS. 1 and 4. The yarn Y extends inwardly through respective holes 98, 100 in the lower ends of sleeve 90 and leg 78, through a guide eye 102 in guide arm 96 on the outer side of the apex 104 defined by outer and inner angularly disposed arm portions 106 and 108 of the arm 96, which arm portions are joined at a second rigid elbow.

Yarn strand Y extends through a hole 110 in an inner enlarged distal end pad portion 112 of guide arm 96 for wrapped engagement about a bobbin B securely engaged on spindle 34. An entrance slot 114 to hole 110 may be provided in the distal end pad portion 112 for ease of threading the yarn strand Y through hole 110 from the outside of arm 96 to the inside of end pad portion 112. The entrance slot 114 may be eliminated if desired. The outer side slot 80' is provided in sleeve 78 to facilitate the initial insertion of the yarn strand Y through the leg and sleeve holes 98 and 100. This preferred structure, it will be appreciated, can be modified within the spirit and scope of the overall disclosure contained herein.

Any conventional type brake, well known to those in the art, is utilized for the purpose of stopping the rotation of the spindle and rotor when a package is completed. In addition, in the preferred embodiment a brake means is provided for the substantially free spinning yarn guide frame to arrest relative rotation of it with respect to the spindle. A suitable arresting brake means may be as disclosed in the drawings; however, other type brakes may be used. As seen, this illustrated brake means 120 is for the free spinning yarn guide frame 30. It is composed of an enlarged bottom plate 122, fixed as by a collar 124, pinned at 126, for rotation with the spindle 34. On this plate there are a pair of vertically, diametrically opposed parallel upwardly extending posts 128 and 130 outboard of the free spinning yarn guide frame legs 78 and 80. On the leg 80 a vertically disposed strip 131 of flexible material, such as leather, is secured, as at 132 for contact with one of the legs 78, 80 of the free spinning yarn guide frame 30 for the purpose of arresting relative motion of rotation between the free spinning yarn guide frame and the spindle, when the rotational movement of the spindle is arrested.

In operation, the yarn strand Y from the traveler on the spinning ring 20 is inserted through the rotor 54, the frame hub 31, leg 78, and the guide eye 102 and hole 110 of the angular arm 96 and pad portion 112 into fixed engagement about the bobbin B on spindle 34. The drive means is then engaged to the twister ring assembly 20 and bobbin B on the spindle 34 by means of drive belts 59 and 42 to drive the spindle and the rotor preferably at the same angular velocity or r.p.m's. The spindle 34 and bobbin B are thereby rotated to wind the yarn Y on the bobbin B. The pad portion 112 bears against the yarn package P as said winding progresses, and the yarn is distributed along the length of bobbin B by the vertical reciprocating movement of carrier bar 24 as above described. Rotational movement is imparted to the yarn guide frame 30 by the pull of the yarn Y exerted by the rotational winding movement of the yarn package P.

The angular configuration of arm 96 and the engagement of pad portion 110 on the yarn package P controls the rotational movement of the frame 30 relative to the spindle. As the winding operation progresses and the package P expands, the angular arm 96 and pad 110 are free to rotate with sleeve 90 on arm 78 to follow the contour of the yarn package P. The hole 100 in leg 78 is of a sufficient width to accommodate the passage therethrough of the yarn strand Y through the complete expansion of the yarn package P.

During operation, the posts 128 and 130 and the brake plate 132 are rotated with the spindle 34; however, when the drive to spindle 34 stops, the coasting movement of the free spinning yarn guide frame 30 which carries the brake strip 131, is arrested by contact of the flap edge of the brake strip 131 with the posts of the plate 122.

It will be appreciated that there is disclosed a process of twisting and winding material to make a yarn package which takes place in a continuous operation and which involves the conventional steps of delivering material to be twisted and guiding that material to a point on a predetermined straight line about which it is twisted and, following that, wound on a bobbin; and wherein there is an improvement in that the twisting and winding steps are each performed at a fixed station, and, these stations each have a mechanism that turns preferably at the same revolutions per minute and are coaxial. At the twisting station what may be considered as an artificial bobbin is utilized, namely the rotor. After the twisting operation, the yarn is directed to a distributor which reciprocates vertically for axial arrangement of the twisted yarn on the bobbin between the fixed twisting station and another fixed station at which the winding operation takes place. Also, the twisted yarn is guided in an improved manner into convolutions on the package being formed, thus forming an improved package of yarn which is quite precise, relatively large, not limited by the size of the hole through the ring in the traveler assembly, which may be free and clear of knots, and which avoids many of the problems of the prior art as enunciated above.

In this invention suitable conventional machine drive means 4, 6 and 8 are used, these drive means being designated schematically in the drawings. The phrase, yarn guide frame, is apt to describe the rotating yarn guide 30; however, the use of the word frame is intended to describe the best mode and preferred embodiment; but it is not intended to limit the invention to the structure disclosed.

It will be appreciated that the size or weight of the traveler may be varied to affect the amount of tension on the material to be twisted and hence may be regarded as a tensioning means. It will be appreciated by those in the art that tensioning means, such as a ring and traveler, are old in the art and does not in and of itself constitute this invention. The tensioning means is utilized in the combination of the rotating spindle on which the package is formed and the substantially free spinning yarn guide frame to distribute the tensioned twisted yarn on the package being formed.

While a preferred form of the instant invention has been herein described, it will be evident to those skilled in the art that various changes and modifications can be made therein without departing from the true spirit of the invention as defined in the appended claims. For example, the frame may be bell-shaped of a transparent plastic material with a yarn guide track formed in the wall thereof, or of other suitable balanced configurations.

What is claimed is:

1. A machine comprising a twisting means to receive material to be twisted and wound on a package, said twisting means being at a first fixed station, said material being received through the twisting means from a roller assembly; said twisting means including a rotor, a first yarn guide passageway through said rotor to direct a twisted strand of yarn radially inwardly and axially, a spindle including support means at a second fixed station in spaced relation from said first station, means rotatably journaling said spindle to said support means in coaxial relation to said rotor, a carrier bar disposed between said stations, said carrier bar having a hole substantially coaxial with said rotor and said carrier bar including means to impart reciprocable movement to said carrier bar, a substantially free spinning rotatable yarn guide on the carrier bar and in coaxial relation with said rotor and said spindle, said yarn guide including at least one outwardly and downwardly formed guide portion for yarn, means rotatably journaling said yarn guide to said carrier bar, yarn guide arm means on said yarn guide to direct the yarn strand for convolutely wound engagement about the length of a bobbin on said spindle in response to said up and down movement of said carrier bar and yarn guide, and means to rotatably drive said rotor and spindle.

2. The device as set forth in claim 1 wherein the roller assembly is at a fixed station with respect to the first fixed station.

3. The device as set forth in claim 1 wherein the first station is above the second station.

4. The machine as set forth in claim 1 wherein said twisting means includes a fixed support member and a twister ring and traveler assembly.

5. The device as defined in claim 1 wherein said yarn guide is of a structure symmetrical with respect to said axis of said rotor and spindle defining said yarn guide frame.

6. The device as defined in claim 5 wherein said arm means includes a sleeve portion rotatably journaled to said structure.

7. The device as defined in claim 6 wherein said arm means further includes a pair of angularly outwardly diverging arm portions, and an enlarged distal end pad portion for engagement against an outer peripheral surface of a yarn package as said package expands on the bobbin during the winding operation.

8. The device as defined in claim 7 including guide means to direct the yarn strand outwardly along an outer side of said diverging arm portions and inwardly through said pad portion for winding engagement on the bobbin.

9. The device as defined in claim 8 wherein said guide means includes a through eye extending generally outwardly from an apex defined by said angularly diverging arm portions and a through hole in said pad portion.

10. The device as defined in claim 1 wherein said means to rotatably drive comprises a pulley fixed to each of said rotor and spindle, and a drive belt engaged between each of said pulleys and an existing drive means extending along the length of a bank of yarn producing machines and conventionally driven at one end thereof by appropriate motor means.

11. The device as defined in claim 1 including brake means to arrest rotational movement of said frame when rotational movement of said spindle is discontinued.

12. The device as defined in claim 11 wherein said brake means includes a plate secured to said spindle, adjacent to and beneath bottom ends of said first and second legs, for rotational movement with said spindle, and means extending upwardly from said plate to engage a flexible projection from said yarn guide frame to arrest rotational movement of said frame when rotational movement of said spindle is discontinued.

13. The device as defined in claim 12 wherein said flexible projection comprises a strip of a suitable flexible material, such as leather, secured to said frame, said strip extending into a path of movement of said upwardly extending means.

14. The device as defined in claim 13 wherein said upwardly extending means comprises a pair of diametrically opposed posts, secured to said plate.

15. The process of twisting and winding material to make a yarn package in a continuous operation comprising the steps of:

(a) delivering the material to be twisted and wound on a package;

(b) guiding the material which is delivered to a point on a predetermined straight path;

(c) twisting the material about the straight path at a first fixed station, and, (d) simultaneously winding the material about the straight path on a bobbin to make a yarn package at a fixed second station at a predetermined location; and (e) axially distributing the twisted material onto the bobbin after the twisting step utilizing a substantially free spinning twisted yarn guide rotatable about the straight path.

16. The process as set forth in claim 15 including the step of maintaining a predetermined tension on the material between said point on a predetermined straight line and said first station.

17. A product comprising a yarn package manufactured in accordance with the process set forth in claim 16.

18. The process as set forth in claim 15 wherein said first station is fixed and said step of distributing the twisted material is performed between said first fixed station and said second fixed station.

19. The process as set forth in claim 15 wherein the step of distributing the twisted material comprises the step of feeding the material tangentially onto the bobbin on which the package is being formed and maintaining pressure on the exterior surface of the convulsions on the bobbin.

20. The process as set forth in claim 15 wherein the twisting and winding steps are performed at substantially the same revolutions per minute.

21. The process as set forth in claim 15 wherein the step of delivering material is performed at a fixed station.

22. A product comprising a yarn package manufactured in accordance with the process set forth in claim 15.

23. A twisting and winding machine as set forth in claim 1 comprising an artificial rotatable bobbin at said fixed twisting station comprising a rotatable tube having a radially facing opening.

24. A twisting and winding machine for making a package of twisted multi-strand material, the machine including driven roller means to deliver the strand material to be twisted and wound on a package, and said machine including a rotatable spindle at a station and upon which a package is to be formed and means to drive the spindle, a bobbin on the spindle, a yarn twisting guide frame between the means to deliver and the station, said frame having a portion in engagement with the surface of the package being formed at all times in operation, tensioning means between the means to deliver and the station for maintaining a predetermined and preselected tension on the material while it travels through the machine between the means to deliver and the station, means to support the yarn guide frame for substantially free spinning coaxial with the spindle and circumferentially around said spindle and including means to axially move the yarn guide frame relative to the spindle, said yarn guide frame comprising means to guide the material onto the surface of the package substantially tangentially of said surface, and arresting means to control relative rotation of the free spinning yarn guide frame in relation to the rotation of the spindle when the angular velocity of the spindle is changed so that the angular velocity of the yarn guide frame does not exceed the angular velocity of the bobbin.

25. The device as set forth in claim 24 wherein said bobbin has an upper end face of a size less than the size of the package to be formed to accommodate unwinding of the material from the package.

26. The device as set forth in claim 25 wherein the bobbin is cylindrical.

27. The machine as set forth in claim 25 wherein the bobbin is cone-shaped.

28. The machine as set forth in claim 24 wherein said tensioning means comprises a traveler means.

29. The process of making a yarn package from material on a machine to form the package in a continuous operation, said process comprising the steps of:

(a) delivering the material to be twisted and wound to a point of the machine;

(b) simultaneously (1) twisting, (2) winding, and (3) axially distributing the material onto a driven rotatable bobbin utilizing a substantially free spinning yarn guide, said bobbin being at a station spaced from said point, (c) said step of distributing including guiding the material onto the surface of the package being formed by a portion of the yarn guide which is at all times in operation in engagement with the surface of the package being formed, (d) applying a predetermined tension at all times to the material when it is between the point and the station and while the package is being formed, (e) limiting at all times in operation the relative rotation of the free spinning yarn guide in relation to the rotation of the driven spindle by an arresting means so that whenever the angular velocity of the spindle is reduced, the rotation of the yarn guide frame is also reduced.

30. A product comprising a yarn guide package manufactured in accordance with the process as set forth in claim 29.

* * * * *